US005177504A

United States Patent [19]

Ishii et al.

[11] Patent Number: 5,177,504

[45] Date of Patent: Jan. 5, 1993

[54] ON-DEMAND TYPE INK JET PRINT HEAD

[75] Inventors: Hiroshi Ishii; Yoshinori Miyazawa; Tsuyoshi Kitahara, all of Nagano, Japan

[73] Assignee: Seiko Epson Corporation, Tokyo, Japan

[21] Appl. No.: 547,734

[22] Filed: Jul. 3, 1990

[30] Foreign Application Priority Data

| | | | |
|---|---|---|---|
| Jul. 3, 1989 | [JP] | Japan | 1-171429 |
| Feb. 7, 1990 | [JP] | Japan | 2-27771 |
| Feb. 7, 1990 | [JP] | Japan | 2-27772 |
| Apr. 11, 1990 | [JP] | Japan | 2-96001 |

[51] Int. Cl.[5] ..... B41J 2/135; B41J 2/045; B41J 2/175

[52] U.S. Cl. ..... 346/140 R

[58] Field of Search ..... 346/140 R, 75

[56] References Cited

U.S. PATENT DOCUMENTS

| | | | |
|---|---|---|---|
| 3,988,745 | 10/1976 | Sultan | 346/140 R |
| 4,559,544 | 12/1985 | Matsumoto et al. | 346/140 R |
| 4,580,147 | 4/1986 | De Young et al. | 346/140 R |
| 4,680,595 | 7/1987 | Cruz-Uribe et al. | 346/140 R |
| 4,755,877 | 7/1988 | Vollert | 358/296 |
| 4,779,099 | 10/1988 | Lewis | 346/1.1 |
| 4,855,764 | 8/1989 | Humbs et al. | 346/140 R |
| 4,962,391 | 10/1990 | Kitahara et al. | 346/140 R |
| 4,998,120 | 3/1991 | Koto et al. | 346/140 R |
| 5,072,240 | 12/1991 | Miyazawa et al. | 346/140 R |

FOREIGN PATENT DOCUMENTS

| | | |
|---|---|---|
| 0054999 | 12/1981 | European Pat. Off. . |
| 0199582 | 4/1986 | European Pat. Off. . |

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An on-demand type ink jet print head having a nozzle plate which is arranged horizontally so that its nozzle openings face upward and cantilevered vibrating members the free ends of which confront the nozzle openings. Ink is held by a capillary force in a gap between the vibrating members and the nozzle plate and is supplied by surface tension in a gap formed between a plurality of members from an ink tank up to the vicinity of the vibrating members. Since the ink is supplied by a capillary force between the ink level in the tank and the vibrating members, the ink supply is stable irrespective of the ink level in the tank. Further, since the ink is ejected in the form of ink droplets produced by a dynamic pressure associated with vibration of the vibrating members within the ink, it is possible to produce fine ink droplets.

15 Claims, 13 Drawing Sheets

FIG. 14(III)
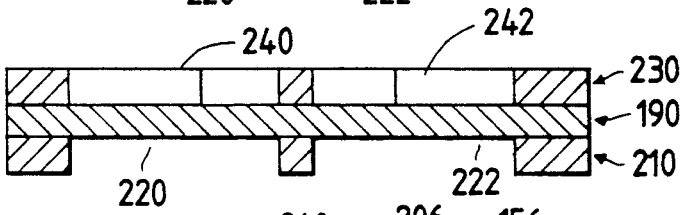

ON-DEMAND TYPE INK JET PRINT HEAD

BACKGROUND OF THE INVENTION

The present invention relates to an ink jet print head in which ink droplets are produced corresponding to a print signal. More particularly, the invention relates to ink jet print head of a type having nozzle openings facing upward.

In an on-demand type ink jet print head, piezoelectric elements are operated in response to a print signal to eject ink in the form of ink droplets from nozzle openings onto a recording sheet. The operating cost of such a print head is lower than a conventional print head of the type in which continuously sprayed ink is attracted to a recording sheet by an electrostatic force, and its size is smaller. Thus, the on-demand type ink jet print head is widely used as a print head for small-sized printers.

In an on-demand type ink jet print head, nozzle openings can be arranged horizontally, facing downward or facing upward. The structure in which the nozzle openings are arranged facing upward, wherein printing is performed on a recording sheet that is set above the nozzle openings, allows the print head to recover ink leaked from the print head itself, thereby contributing to easy maintenance.

Such an on-demand type ink jet print head in which the ink ejection nozzles are arranged facing upward is disclosed in Japanese Utility Model Unexamined Publication No. 102539/1987. In the ink jet print head disclosed in this publication, one of the walls of a chamber communicating with the vertically arranged nozzles is formed of a resilient plate, and piezoelectric elements are firmly fixed to the plate. According to this print head, the ink is ejected upward from the nozzles by causing the resilient plate to deform upon application of a print signal to the piezoelectric elements. On the other hand, such deformation of the chamber causes the volume of the ejected ink droplets to be large, thereby disadvantageously entailing a relatively long period of time in drying the recording sheet.

To reduce the volume of the ink droplets, a print head has been proposed in which cantilever-type vibrating plates are arranged in the ink supply confronting the nozzle openings and the ink is jetted from the nozzle Openings by elastic vibration of the vibrating plates. Such a print head is disclosed in Japanese Patent Examined Publication No. 8953/1980. With this print head, the volume of the ink droplets can be made smaller by reducing the size of the vibrating plate.

However, in the print head disclosed in the above Publication No. 8953/1980, it is required that ink be supplied between the nozzle openings and the vibrating plates at all times. Therefore, if the nozzle openings are arranged facing upward in this type of print head, it is extremely difficult to supply the ink between nozzle plate and the vibrating plates.

That is, to introduce the ink between the nozzle plate and the vibrating plates in such a manner that the ink does not leak from the nozzle openings, the ink must be at a higher level than the nozzle plate. However, because it is difficult to supply ink to this region continuously, the size of a reserve tank must be made large to prevent an unwanted decrease in the ink level.

SUMMARY OF THE INVENTION

With a view of overcoming the difficulties noted above, the present invention provides an upward directed type print head which uses cantilever-like vibrating plates, which allows the ink in the tank to be used efficiently, and whose size can be made small.

More specifically, the present invention provides an on-demand type ink jet print head comprising a horizontally arranged nozzle plate having a plurality of nozzle openings arranged facing upward; vibrating members, one end of each of which is secured to a base and the other end confronting the nozzle openings, the vibrating members being arranged horizontally with a gap wide enough to hold the ink in cooperation with the nozzle plate by a capillary force; a frame member serving also as an ink tank; and ink supplying means for supplying ink from the ink tank to the vibrating member by a capillary force.

Further, the present invention provides an upwardly directed type print head having a member for stably supplying ink from the ink tank to the nozzle plate.

Still further, the present invention provides a print head suitable for use with hot melt type ink which is solid at ambient temperature and which is melted at the time of printing, in which bubbles mixed into the ink are discharged, thereby preventing differences in characteristics between each nozzle from occurring.

DESCRIPTION OF THE PREFERRED EMBODIMENTS

Figure 1:
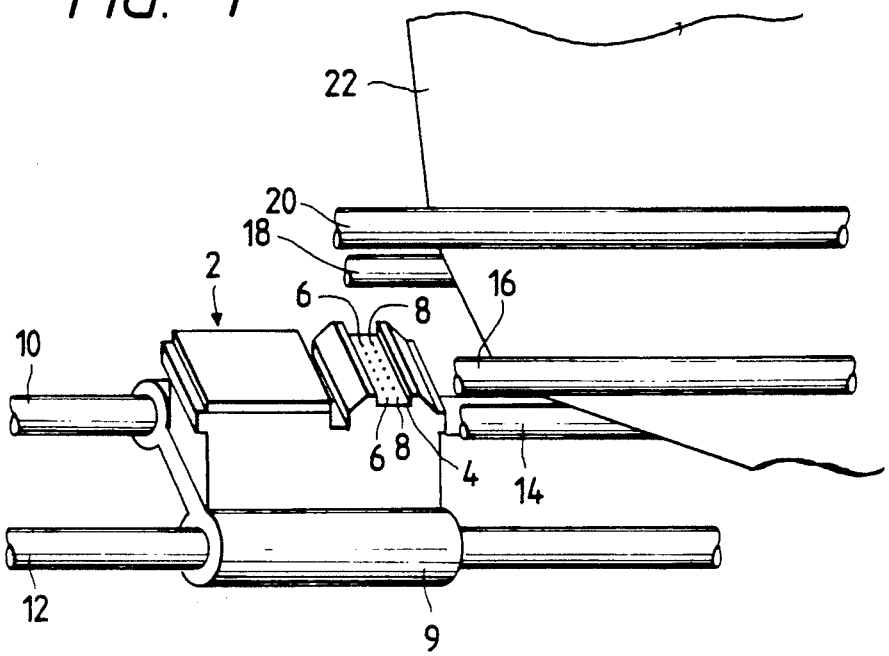
FIG. 1 perspective view of a main portion of a preferred embodiment of a recording apparatus using a print head according to the present invention.

FIG. 1 depicts a first preferred embodiment of a recording apparatus using an ink jet head according to the present invention. In this figure, reference numeral 2 designates an ink jet head constructed in accordance with the present invention. The ink jet head 2 is movably arranged on guide members 10 and 12 through a carriage 9 so that nozzle openings 6 and 8 are parallel to a sheet forwarding direction with a nozzle plate 4 oriented in the horizontal plane, and which is moved in a reciprocating manner by a drive device (not shown). On the upper side of the guide members 10 and 12 are provided recording sheet guide members 14, 16, 18, and 20 arranged so as to confront the guide members 10. The recording sheet guide members serve to guide a recording sheet 22 orthogonally to the guide members 10 and 12.

Figure 2:
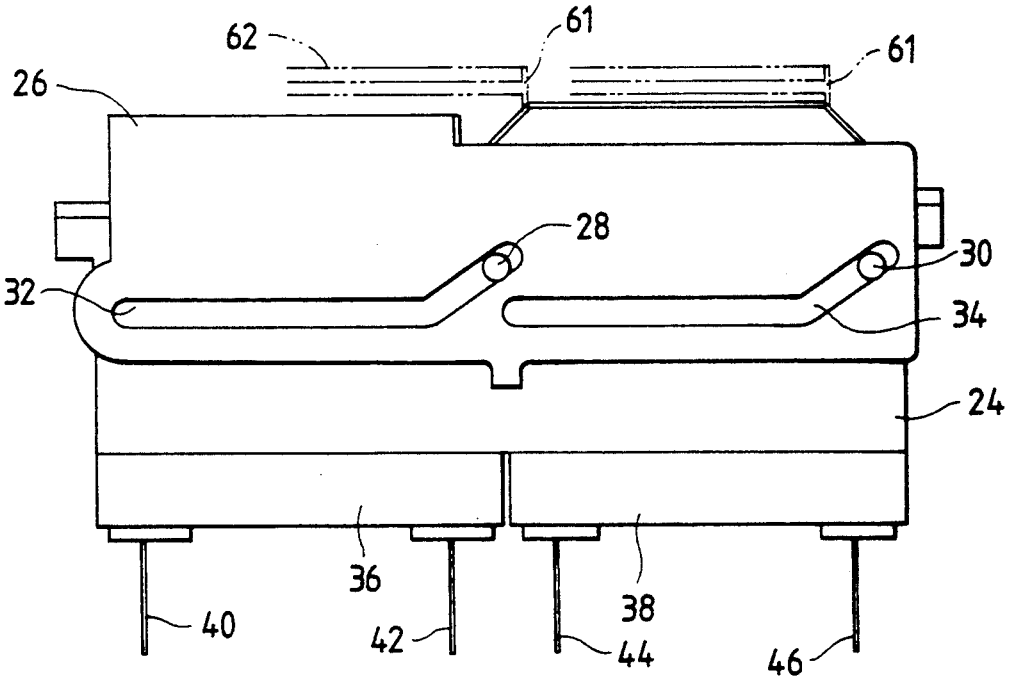
FIG. 2 is a side view showing the structure of a case of the print head according to the present invention.

FIG. 2 shows the general appearance of the ink jet head of the present invention. A cover 26, removably mounted on a head frame 24, is slidably mounted on guide pins 28 and 30 arranged on the head frame 24 and guide grooves 32 and 34 arranged on the cover 26. On the bottom of the head frame 24 are provided heaters 36 and 38 for melting hot melt ink. Lead wires 40, 42, 44, and 46 supply power to the heaters.

Figure 3:
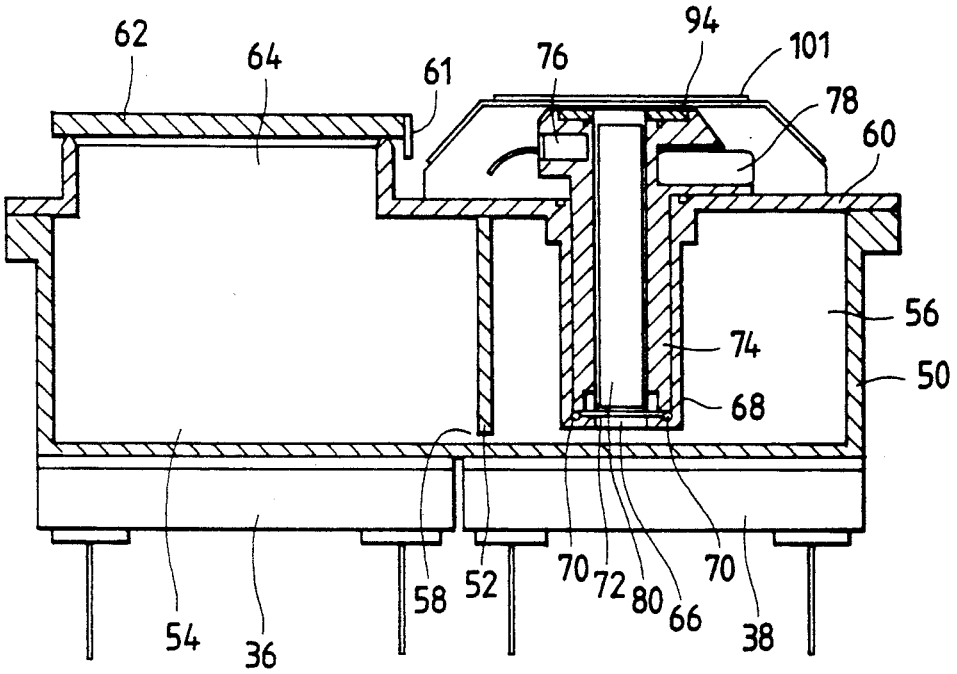
FIG. 3 is a sectional view showing a first embodiment of the print head according to the present invention.

FIG. 3 shows the ink jet head. In this figure, a head frame 50 is a container whose upper portion is open and which is divided into a reserve tank 54 and a receiving chamber 56 by a partitioning plate 52 located at the center. A through-hole 58 below a head frame 50 communicates the tank 54 and chamber 56.

An upper casing 60 is mounted on the upper portion of the head frame 50. An ink injecting inlet 64 arranged on a portion corresponding to the reserve tank 54 is sealable by a lid 62 having a cleaner 61 such as a brush On the side of the nozzle plate. A cylindrical body 68 having an opening 66 on the bottom is arranged on a portion corresponding to the receiving chamber 56. The cylindrical body 68 is provided with a filter 72 through a seal member 70 at the opening 66 on the bottom, and contains therein a holder 74 having an ink droplet producing structure incorporated therein.

The holder 74 is of such a size that the lower end thereof is abutted against the seal member 70 and the upper portion thereof is higher than the upper casing 60. On the wall surface at a point higher than the upper casing 60 is provided a temperature detector 76 and a heater 78 controlled by a signal from the temperature detector 76.

Figure 5:
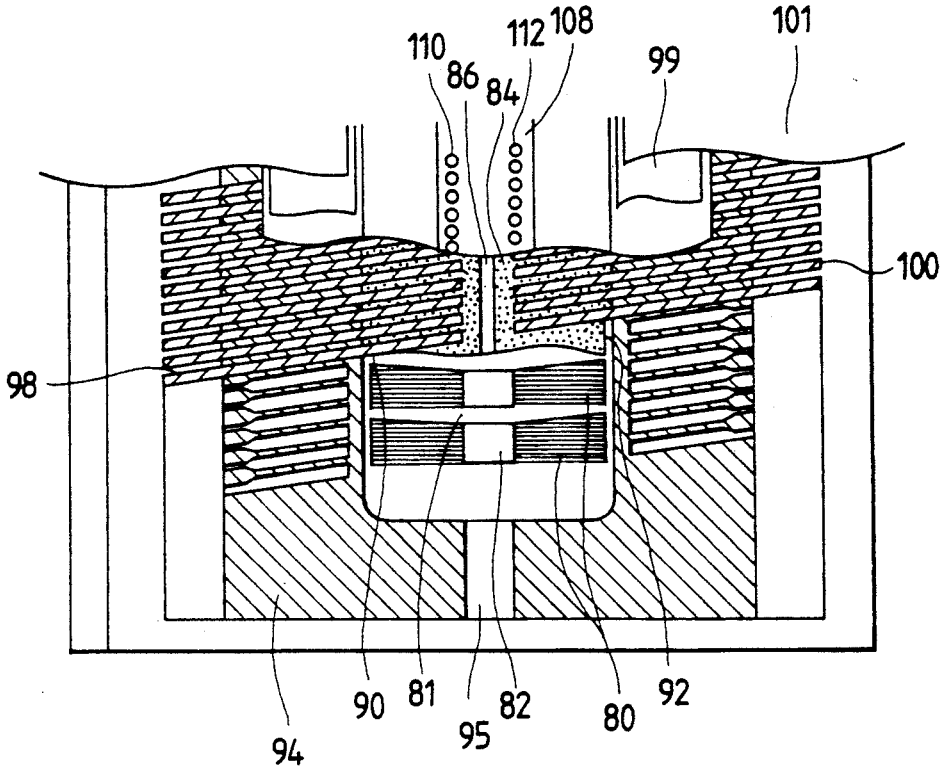
FIG. 5 is a top view showing the positional relationship of parts without a nozzle plate and a part of the vibrating plate so as to show an ink supply plate, a back plate, and the vibrating plates.

Ink supply plates 80, which are thermally resistant thin plates made of a metal, ceramic or the like, are arranged both vertically and parallel to the array of the vibrating plates (see FIG. 5). The plates have therebetween a gap 81 of width selected so as to suck ink up to vibrating plates (described later) by a capillary force. It has been found that a suitable gap width is, for instance, about 0.1 mm at both ends and about 0.3 mm at the center. The upper ends of the ink supplying plates 80 are coplanar, and the center thereof is provided with a recess 82 arranged parallel to the array of nozzle openings. Ends of a back plate 84 are secured so as to be aligned with both upper ends of the ink supply plates 80, and the center thereof is provided a through-hole 86 which communicates with the recess 82 of the ink supply plates 80. The size of the through-hole 86 is such that the ink cannot be held by surface tension. Also,.the size of the back plate 84 is such that gaps 90 and 92 for generating a capillary force large enough to suck up the ink between the back plate and window of the vibrating plate block can be formed at both ends thereof.

Figure 6:
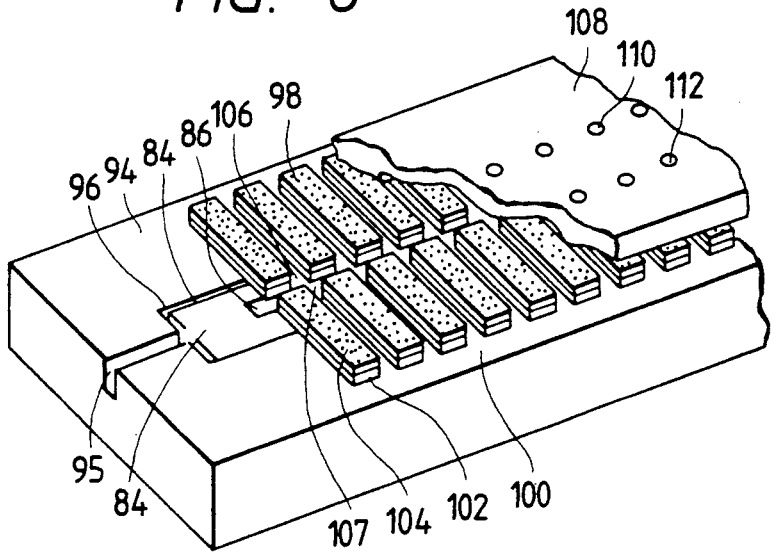
FIG. 6 is a perspective view in which part of the nozzle plate is cut away to show the structure around a vibrating plate block.

The vibrating plate block 94 is provided with a rectangular window 96 at the center thereof as shown in FIG. 6, and the vibrating plates 98 and vibrating plates 100 are secured so that their ends face each other in a cantilever-like manner. The vibrating plates 98 and 100 are constructed by bonding a metal or ceramic resilient thin plate 102 constituting a plate spring to a piezoelectric element plate 104 having on both ends electrodes to which a print signal is applied. The vibrating plates 98 and 100 are so arranged that the end thereof is provided with a gap wide enough to hold the ink by a capillary force and that gaps 106 and 107 wide enough to suck the ink to the surface of the vibrating plates by a capillary force are formed between the adjacent vibrating plates, the gap preferably being about 80 μm in width.

Figure 4:
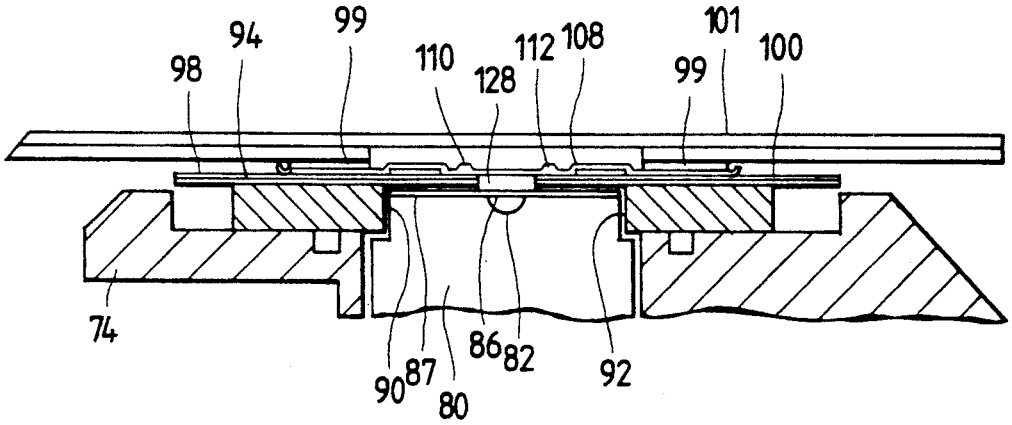
FIG. 4 is an enlarged sectional view showing the structure around vibrating plates of the device shown in FIG. 3.

Returning to FIG. 4, a nozzle plate 108 is secured to a vibrating plate block 94 by a frame 101 through a seal member 99 so that a gap wide enough to suck the ink by a capillary force, preferably about 10 μm in width, is formed together with the surface of the vibrating plates 98 and 100 A portion confronting the vicinity of the ends of the vibrating plates 98 and 100 is provided with nozzle openings 110 and 112 for injecting ink droplets upwards.

In the device thus constructed, hot melt ink having the constituency of a solid wax at ambient temperature is charged in the reserve tank 54 from the ink injecting inlet 64 and heated by the heater 36 to about 80° C. Then, the ink mass is melted and liquified, allowing the ink to flow into the receiving chamber 56 from the communicating through-hole 58 below the partitioning plate 52. Since this receiving chamber 56 is also heated to the melting temperature by the heater 38, the liquified state of the ink can be maintained. The ink flows into the holder 74 through the filter 72 disposed on the bottom of the cylindrical body 68 so as to remove impurities therefrom. The ink introduced into the holder 74 is raised through gaps 81 formed by the ink supply plates 80 which extend higher than the ink level by a capillary force. As the ink moves above the upper casing 60 in this way, the ink is heated to temperatures above its melting point and below its boiling point, e.g., 100° to 200° C., through heat supplied from an auxiliary heater 78, to thereby reduce the viscosity of the ink. Upon arrival of the ink at the upper end of the ink supply plate 80, the ink starts flowing from the gap between the ink supply plates 80 to the fixed-end side of the vibrating plates 98 and 100. Accordingly, the ink is supplied uniformly in the direction of the array of the vibrating plates 98 and 100.

Figure 7:
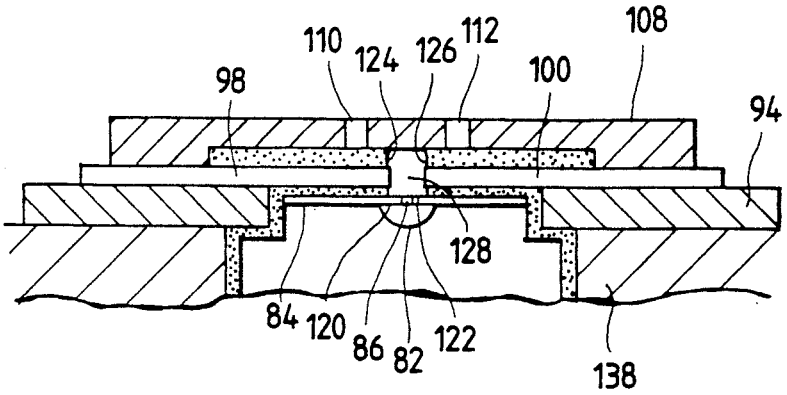
FIG. 7 is a sectional view showing the state of supplying the ink around the vibrating plates in the device shown in FIG. 3.

The ink further enters the gaps 90 and 92 formed between the lateral surface of the ink supply plate 80 and the surface of the window of the vibrating plate block 94 to be further raised through the gaps by a capillary force, and is introduced to the space between the front surface of the back plate 84 and the rear surface of the vibrating plates 98 and 100 by a capillary force, thereby to form meniscuses 120 and 122 at the ends of the vibrating plates 98 and 100 (FIG. 7).

The ink ascends along the gaps 106 and 107 formed on the lateral sides of the vibrating plates 98 and 100 due to a capillary force, and enters the gap between the rear surface of the nozzle plate 108 and the front surface of the vibrating plates 98 and 100, thereby to form meniscuses 124 and 126 at the ends of the vibrating plates 98 and 100.

When a print data signal is applied to the vibrating plates 98 and 100 from a computer or the like (not shown) under this condition, the piezoelectric element plate 104 is deformed so that the front end thereof is biased downward by the resilient thin plate 102. When application of the signal is interrupted, the deformation of the piezoelectric element plate 104 is removed, whereupon the biasing force stored in the resilient thin plate 102 is released, propelling it toward the nozzle plate 108, and thereby vibrating the end portion of the piezoelectric element plate 104 through a vibrating distance of about 10 μm. Accordingly, ink present between the vibrating plates 98 and 100 and the nozzle plate 108 is ejected upward in the form of ink droplets from the nozzle openings 110 and 112. The ink droplets are received on a recording sheet, then cooled and solidified form dots on the recording sheet. When the vibrating plates 98 and 100 return to their original positions, ink present between the back plate 84 and the vibrating plates 98 and 100 replenishes the portion of ink that has been discharged. In practice, the ink between the back plate 84 and the vibrating plates 98 and 100, which are in communication with each other, can be replenished smoothly. Also, since the vibrating plates 98 and 100 are coplanar, no delay in supplying the ink due to improper positioning of the vibrating plates will occur. Further, since the ink moves from the region where no ink droplets are produced to the region where ink droplets are produced, the ink present around the back plate 84 can be sucked up along the entire gap between the vibrating plates 98 and 100.

When the vibrating plates 98 and 100 return to their original positions after the ink has been discharged, the pressure in the vicinity of the vibrating plates 98 and 100 tends to be negative temporarily. However, since the meniscuses 124 and 126 of the ends of the vibrating plates 98 and 100 are in communication with the atmosphere, it is ensured that the ink is supplied to the gap between the nozzle plate 108 and the vibrating plates 98 and 100 by a capillary force without breaking the meniscuses 124 and 126 of the nozzle openings 110 and 112.

In the course of the printing operation, the bubbles produced in the ink present between the vibrating plates 98 and 100 and the back plate 84 are pushed out into the ends of the vibrating plates 98 and 100 through movement of the vibrating plates 98 and 100, and discharged to a space 128 from the meniscuses 120, 122, 124, and 126. The space 128 communicates not only with the recess 82 of the ink supply plates 80 through the through-hole 86 of the back plate 84, but also with the air from a groove 95 in the vibrating plate block 94, thereby causing no increase in pressure around the vibrating plates.

Even if the ink level in the reserve tank 54 decreases after a long printing operation, the ink supplying function is performed without interruption due to the pressure of the meniscuses 124 and 126 of the nozzle openings 110 and 112 and the meniscuses 120 and 122 of the ends of the vibrating plates 98 and 100, thereby allowing the ink to be supplied stably between the nozzle plate 108 and the vibrating plates 98 and 100. Further, even if the ink level within the reserve tank 54 and the receiving chamber 56 changes radically, such as by an external impact exerted on the print head during printing, the ability to supply sufficient ink to form the ink droplets is not adversely affected because the ink is supplied consistently to the vibrating plates 98 and 100 through the ink supply plates 80.

In the case where paper fragments or dust is deposited on the surface of the nozzle plate 108 through prolonged use of the print head, the lid 62 can be moved toward the nozzle plate side to cause the cleaner 61 mounted on the end of the lid 62 to rub the surface of the nozzle page 108, which ensures that such contaminants are removed. Although such a cleaning operation causes the contaminants to be deposited on the end of the cleaner 61, such matter is not allowed to enter the lower portion of the nozzle plate 108 because only nozzle openings are arranged on the nozzle plate 108.

Figure 8:
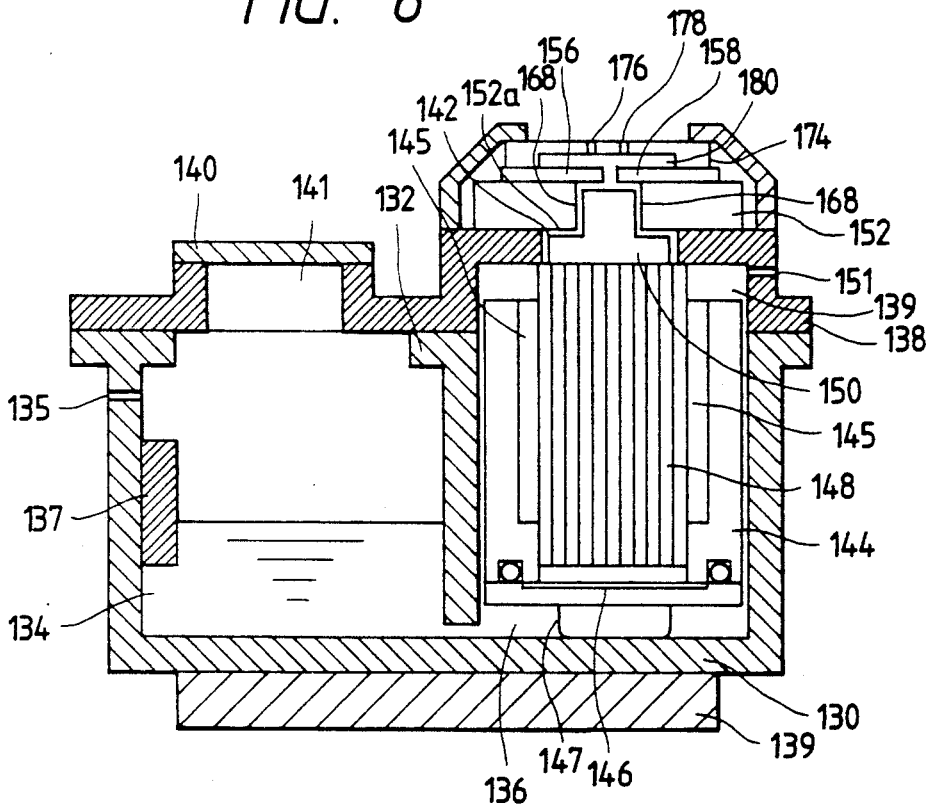
FIG. 8 is a sectional view showing a second embodiment of the print head of the present invention.

FIG. 8 shows a second embodiment of the present invention. In this figure, a head frame 130 is divided into a reserve tank 134 and a receiving chamber 136 by a partitioning plate 132, with the tank and the chamber being communicated with each other at the bottom thereof. In the upper portion of the head frame 130 is arranged an upper casing 138, whereas in the lower portion there is provided a heater 139 for melting the ink. On the side of the reserve tank 134 of the upper casing 138 is provided an ink injecting inlet 141 which is sealed by a lid 140. A window 142 for accommodating a back block 150 (described later) is provided on the side of the receiving chamber 136.

A holder 144 arranged within the receiving chamber 136 has a filter 146 at the opening of the bottom thereof and an ink supply structure 148 (described later) therein. The upper end of the ink supply structure 148 is pressed against the upper casing 138 by a holder spring 147.

Figure 9:
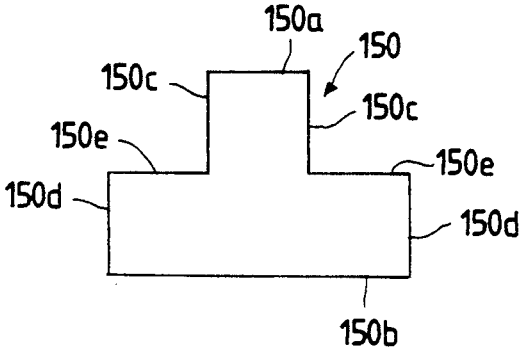
FIG. 9 is an enlarged side view showing a back plate block of the device shown in FIG. 8.
Figure 10:
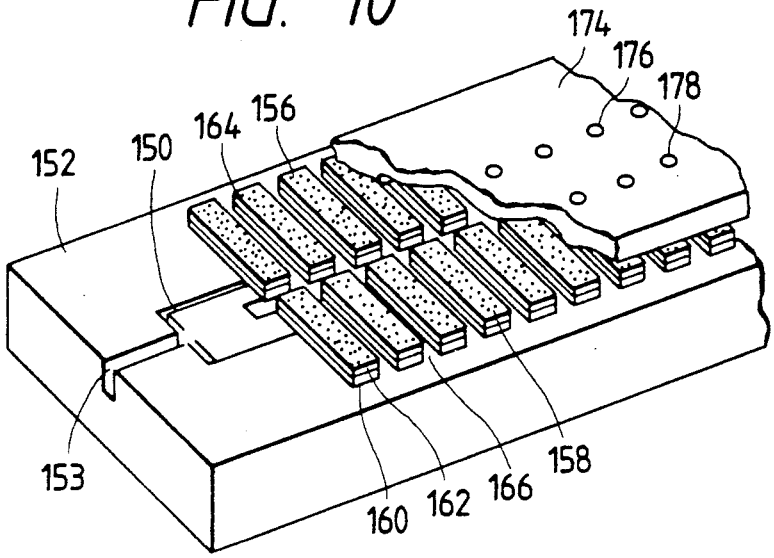
FIG. 10 is a perspective view in which part of the nozzle plate is cut away to show the structure around the vibrating plate block of the device shown in FIG. 8.

The back block 150, which has the configuration of an inverted "T" in section as shown in FIG. 9, has parallel planes 150*a* and 150*b* on its upper and lower surfaces, vertical planes 150*c* and 150*d* on its lateral surfaces, and a horizontal step 150*e* on its upper surface at the center. The back block 150 is abutted against the upper end of the ink supply structure 148 and is secured to a fixing member (not shown) so as to maintain a predetermined positional relationship with respect to the window 142 of the upper casing 138 and a window 154 of the vibrating plate block 152.

The vibrating plate block 152 is secured at the center so as to cause the vibrating plates 156 and the vibrating plates 158 to confront with each other in a cantilever-like manner at their ends on both sides of the rectangular window 154. The vibrating plates 156 and 158 are constructed by bonding a resilient thin plate 160 made of a metal or ceramic plate spring material to a piezoelectric element plate 162 having on both sides electrodes to which a print signal is to be applied. These vibrating plates 156 and 158, which form a gap having a width sufficiently great so as not to retain ink by a capillary force at their end, are arranged so as to form gaps 164 and 166 between the confronting vibrating plates so that the ink can be sucked to the surface of the adjacent vibrating plates by a capillary force.

Figure 11:
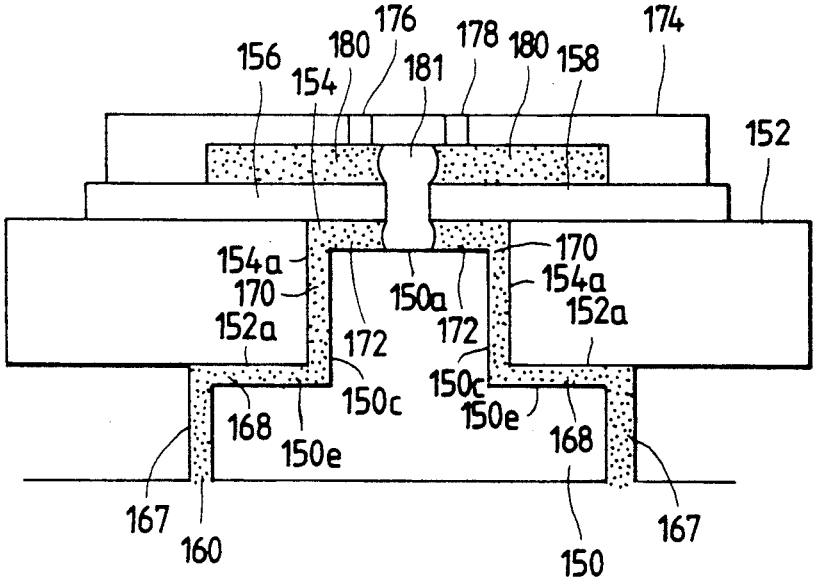
FIG. 11 is a sectional view showing the state of supplying the ink around the vibrating plate block of the device shown in FIG. 8.

The vibrating place block 152 forms, as shown in FIG. 11, not only a gap 168 wide enough to allow the ink to be sucked by a capillary force between the bottom surface 152*a* and the steps 150*e*, 150*e* of the back block 150, and a gap 170 wide enough to allow the ink to be sucked by a capillary force between a side wall 154*a* of the window 154 and side walls 150*c*, 150*c* of the back block 150, but also a gap 172 wide enough to allow the ink to be held by a capillary force between the upper surface 150*a* and the vibrating plates 156 and 158. Also, a groove 153 communicating with the atmosphere is provided at least on one side of the vibrating plates 156 and 158 in their array direction.

Returning to FIG. 8, a nozzle plate 174 having nozzle openings 176 and 178 on a portion confronting the ends of the vibrating plates 156 and 158 is secured on the vibrating plate block 152 so that its back surface forms a gap 180 wide enough to hold ink by a capillary force, in cooperation with the front surfaces of the vibrating plates 156 and 158.

Figure 12A:
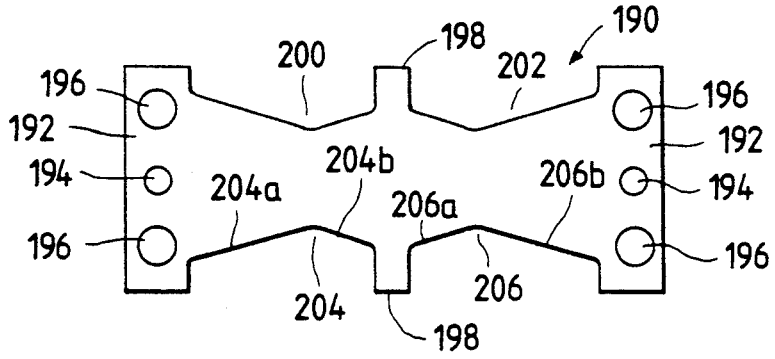
FIGS. 12*a*, 12*b*, and 12*c* are front views each showing a member constituting ink supply structure of the device shown in FIG. 8.
Figure 12B:
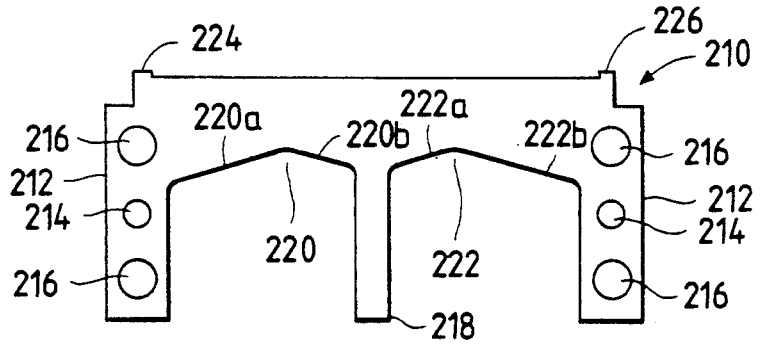
Figure 12C:
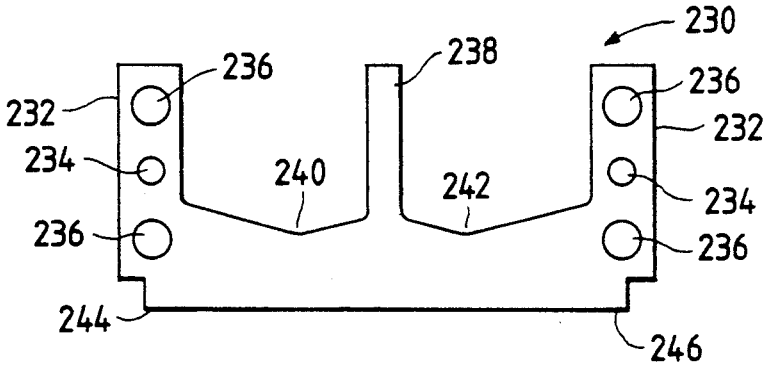

FIGS. 12*a*, 12*b*, and 12*c* show members constituting the ink supply structure 148. These members are formed of a thermally resistant thin film such as a metal or ceramic. A first member 190 shown in FIG. 12*a* is provided with position reference holes 194 on both lateral sides 192, bolt holes 196 for inserting fixing bolts for assembly, and projections 198 vertically at the center. Around the center between both lateral sides 192 and the projections 198 are angled notches 200, 202, 204, and 206 arranged to form a recess facing the center line in the horizontal direction.

Further, a second member 210 shown in FIG. 12*b*, which has substantially an "E" shape in section, is provided with position reference holes 214 on both lateral sides 212 and bolt holes 216 and a projection 218 at the center. Between both lateral sides 212 and the projection 218 are angled notches 220 and 222 arranged to form a window together with the notches 200 and 202 of the first member 190. The second member 210 is further provided with projections 224 and 226 of about 0.1 mm in height which form a gap wide enough to produce a capillary force when assembled together with the bottom surface 150*b* of the back block 150.

A third member 230 shown in FIG. 12*c*, which is an inverted version of the second member 210, also has a substantially "E" shape in section and is provided with position reference holes 236 and a projection 238 at the center. Between both lateral sides 232 and the projection 238 are angled notches 240 and 242 arranged to form a window together with the other notches 204 and 206 of the first member 190.

Figure 13A:
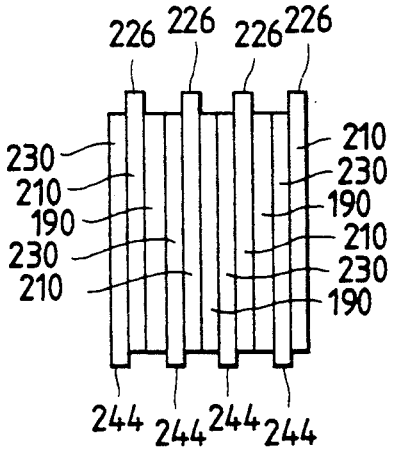
FIGS. 13*a*, 13*b*, and 13*c* are a side view, a front view, and a top view of an ink supplying structure constituted by the members shown in FIGS. 12*a*, 12*b*, and 12*c*, respectively.
Figure 13B:
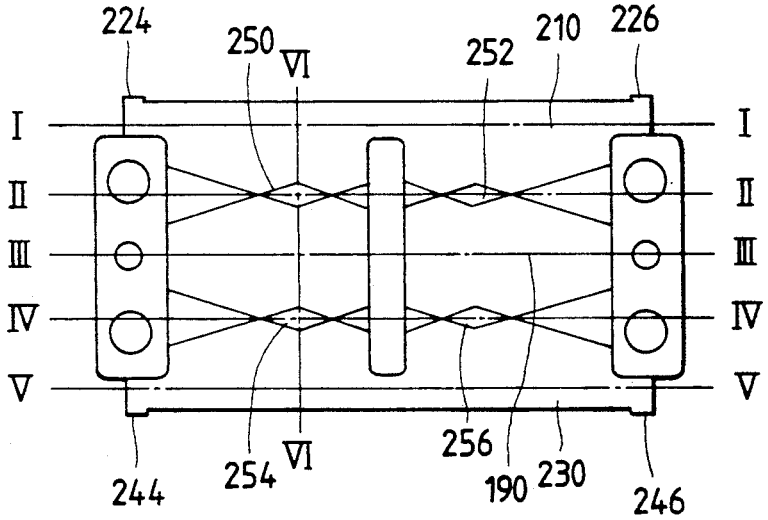
Figure 13C:
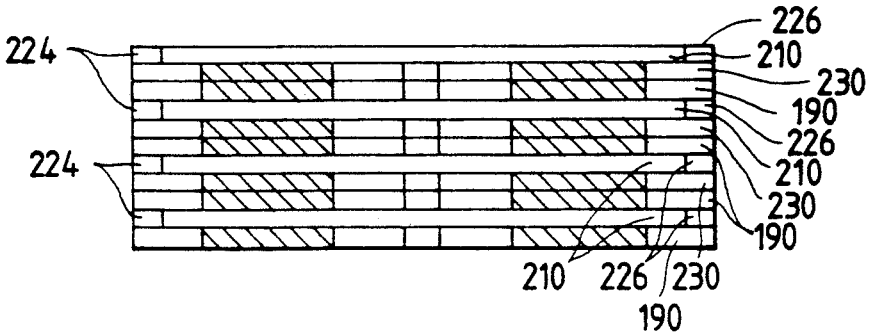

These members are laminated in the sequence of the first member 190, the third member 230, and the second member 210 while positioned by reference holes 194, 214, and 234 as shown in FIG. 13*a*, and then fixed by inserting the bolts into the bolt holes 196, 216, 236 after assembly to form the ink supply structure. Accordingly, as shown in FIGS. 13*b* and 14(II) and 14(IV), the apexes of the notches 200, 202, 204, and 206 of the first member 190, of the notches 220 and 222 of the second member 210, and of the notches 240 and 242 of the third member 230 form windows 250, 252, 254, and 256 which communicate in the laminating direction.

Figure 14I:
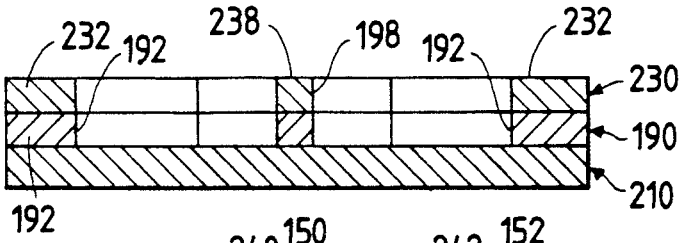
FIGS. 14(I) to 14(V) are diagrams each showing a printing path structure in the section taken along lines I to V, respectively, in FIG. 13*b;*
Figure 14:
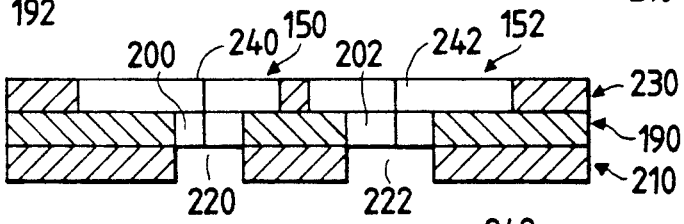
Figure 14:
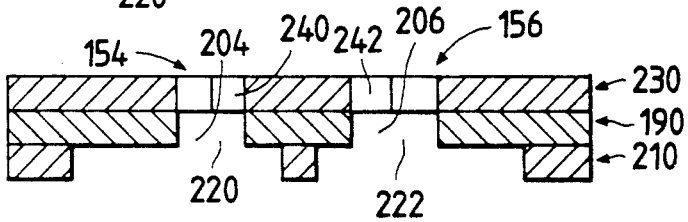
Figure 14V:
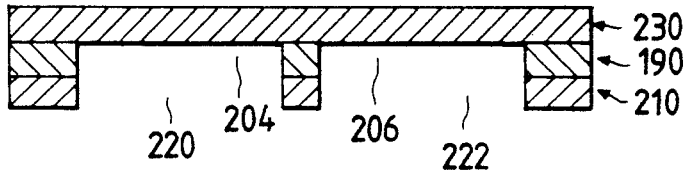
Figure 15:
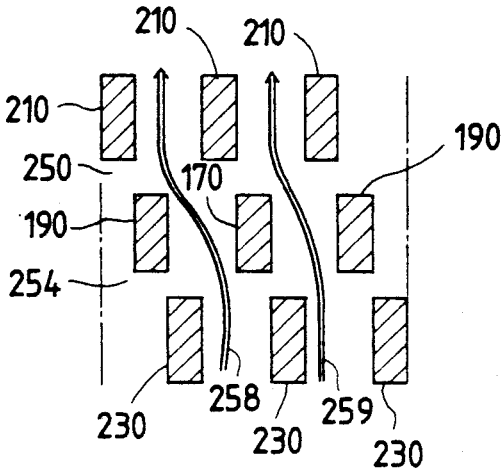
FIG. 15 is a diagram showing the ink supply path structure in a section taken along a line VI in FIG. 13*b;*

Also, in the section of each of the levels I through V of the ink supply structure 148, as shown in FIGS. 14(I) to (V), respectively, the notches 200, 202, 204, 206, 220, 222, 240, and 242 of the respective members 190, 210, and 230 communicate with each other through the windows 250, 252, 254, and 256, thereby to form a vertically running ink supply path 258 as shown in FIG. 15.

Since the ink supply structure 148 is constructed by laminating the thin plates having notches, not only is the space occupancy increased to thereby increase the occupancy of the ink supply path in the tank, but also the specific heat can be-reduced by reducing the total density, thereby allowing the heating time for melting the ink to be reduced.

According to this embodiment, the hot melt ink charged in the reserve tank 134 is heated and melted by the heater 139. The bubbles produced at this time are discharged to the outside through a vent hole 135. The ink introduced from the reserve tank 134 to the receiving chamber 136 ascends up to level IV (FIG. 13*b*) by a capillary force along the gap (FIG. 14(V)) formed by the notches 204, 206, 220, and 222 of the first and second members 190 and 210 constituting the ink supply structure 148, and from level IV it is further elevated along the gap (FIG. 14(IV)) formed by the notches 220 and 222 of the second member 210. In the course of the elevation, the bubbles contained in the ink enter the windows 254 and 256, and the bubbles are entrapped by the apex of the inclined surfaces 206*a* and 206*b* forming the notches 204 and 206 of the first member 190, and move horizontally along the windows 254 and 256, to be discharged into an upper space 139 defined by a gap 145 formed together with the holder 144, and then into the atmosphere from a through-hole 151 of the upper casing 138. The ink elevated to level III (FIG. 13*b*) along the gap formed by the notches 220, 222, 240, and 242 of the second and third members 210 and 230 is further elevated along the gap (FIG. 14(II)) formed by the notches 240 and 242 of the third member 230. The ink is elevated to level I (FIG. 13*b*) along the gap formed by the notches 200, 202, 240, and 242 of the first and third members 190 and 230, to arrive the upper end of the first and third members 190 and 230, to thus arrive at the upper end of the ink supply structure. In the course of such elevation, the bubbles contained in the ink enter the windows 250 and 252, and the bubbles are entrapped by the apex of the inclined surfaces 220*a* and 220*b* and the apex of the include surfaces 222*a* and 222*b* forming the notches 220 and 222 of the second member 210, and move horizontally along the windows 250 and 252 to be discharged into the upper space 138 from the gap 145 formed together with the holder 144, and then into the atmosphere from the through-hole 151 of the upper casing 138.

Thus, the ink elevated up to the surface of the back block 150 enters the gap formed between the projections 224 and 226 of the second member constituting the ink supply structure 148 and the bottom surface 150*b* of the back block 150, is further elevated along a gap 167 formed together with the opening 168 of the upper casing 138 and a gap 168 formed together with the vibrating plate block 152, and still further elevated along a gap 170 formed between the window 154 of the vibrating plate block 152 and the back block 150 by a capillary force to supply the ink from the fixed end side of the vibrating plates, forming a meniscus together with the back block 150 at the end of the vibrating plates 156 and 158. From this point, the ink further enters a gap formed between the upper surface 150*a* of the back block 150 and the vibrating plates 156 and 158, thereby to form a meniscus together with the nozzle plate 174 at the end of the vibrating plates 156 at 158.

When a print signal is applied to the vibrating plates 156 and 158 under this condition, the vibrating plates 156 and 158 are sprung toward the nozzle plate 174, so that the ink present between the vibrating plates 156 and 158 and the nozzle plate 174 is discharged upward in the form of ink droplets from the nozzle openings 176 and 178. As the vibrating plates return to their original position after the ink has been discharged, the pressure in the vicinity of the vibrating plates 156 and 158 tends to be negative temporarily. However, since the meniscuses at the ends of the vibrating plates 156 and 158 communicate with the air along space 181 at the end of the vibrating plates 156 and 158 through the groove 153 of the vibrating plate block 152, it is ensured that the ink is supplied to the gap between the nozzle plate 174 and the vibrating plates 156 and 158 by a capillary force so as to form ink droplets for a subsequent ejection without breaking the meniscuses of the nozzle openings 176 and 178.

Also, even if the hot melt type ink, which repeats the cycle of melting and solidification, produces many bubbles due to vibration or the like, the bubbles can be removed from the ink supply path prior to their arriving at the vibrating plates 156 and 158 by the windows 250, 252, 254, and 256 which are formed by the members 190, 210, and 230 so as to communicate with each other horizontally. Thus, the printing operation can be performed with high reliability.

When the ink level within the reserve tank 134 is reduced from the specified level after prolonged printing, a signal is applied from an ink detector 137 thereby to prompt the operator to replenish the ink.

According to this embodiment, the ink supply structure 148 and the vibrating plates 156 and 158 are connected through the back block 150, so that not only the gap between the window 142 of the upper casing 138 and the window 154 of the vibrating plate block 152 which constitute the ink supply path can be formed with high accuracy by changing the size of the back block 150 or polishing it, but also retention of the bubbles produced in the ink is prevented because the ink can be supplied from the fixed end portion of the vibrating plates 156 and 158.

Figure 16:
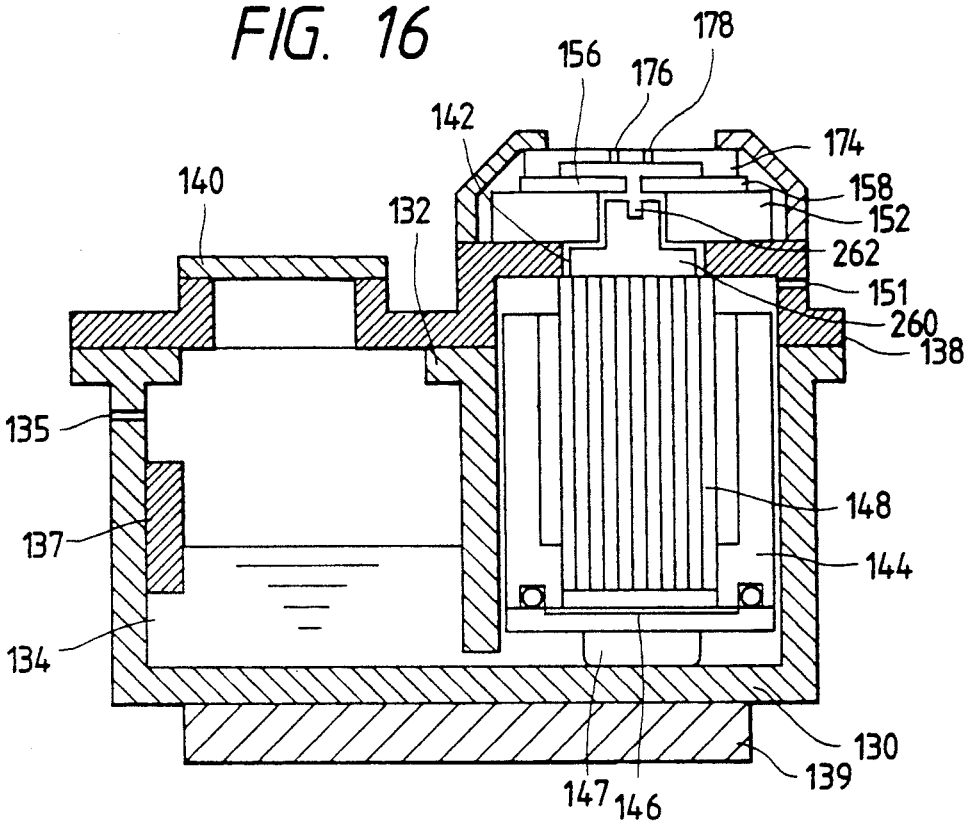
FIG. 16 is a sectional view showing a third embodiment of the print head according to the present invention.
Figure 17:
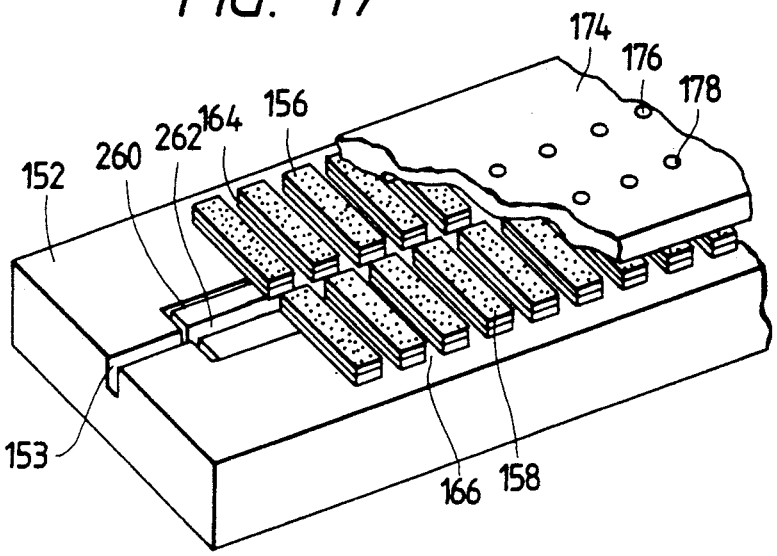
FIG. 17 is a perspective view in which part of the nozzle plate is cut away to show the structure around the vibrating plate block of the device shown in FIG. 16.
Figure 18:
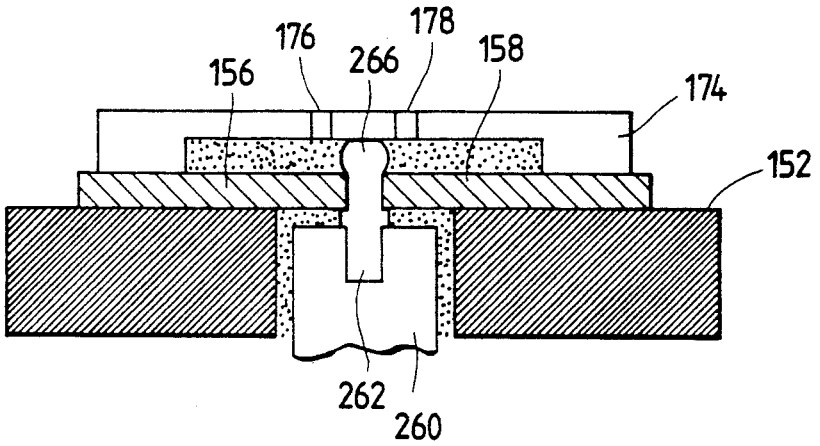
FIG. 18 is a sectional view showing the state of supplying the ink around the vibrating plates of the device shown in FIG. 16;.

FIG. 16–18 shows a third embodiment of the present invention. A back block 260 arranged on the upper end of the ink supply structure 148 not only forms a gap wide enough to suck the ink through the through-hole 142 of the upper casing 138, the window 154 of the vibrating plate block 152, and the lower surface of the vibrating plates 156 and 158, but also is provided with a groove 262 in the vibrating plate array direction at the center of the upper surface, thereby communicating with the atmosphere through the groove 153 (FIG. 17) of the vibrating plate block 152.

According to this embodiment, the ink sucked to the back block 260 by the ink supply structure 148 enters the gap formed between the vibrating plates 156 and 158 and the upper end surface of the back block and forms a meniscus at the end of the vibrating plates. The ink is also introduced into the gaps formed by the nozzle plate 174, the vibrating plates 156 and the vibrating plates 158 by a capillary force acting in the gaps 164 and 166 formed between the adjacent vibrating plates 156 and the vibrating plates 158, thereby forming a meniscus at the end of the vibrating plates 158. Accordingly, the region demarcated by the confronting vibrating plates 156 and 158 forms space 266 that communicates with the groove 262 of the back block 260.

The bubbles produced between the vibrating plates 156 and 158 and the back block 260, or between the nozzle plate 174 and the vibrating plates 156 and 158, are pushed out into the space 266 by movement of the vibrating plates 156 and 158, thereby being discharged into the atmosphere from the back block 260 through the groove 153 of the vibrating plate block 152.

Figure 19:
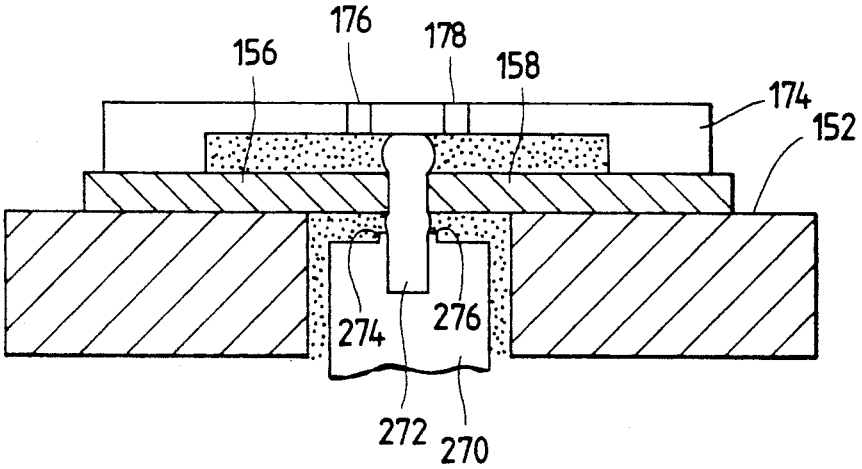
FIG. 19 is a sectional view showing a fourth embodiment of the present invention and the state of supplying the ink around the vibrating plates.

FIG. 19 shows a fourth embodiment of the back block. Reference numeral 270 designates a back block whose lower surface is abutted against the ink supply structure 148. The upper portion of the part of the back block where the window 154 of the vibrating plate block 152 is located is provided not only with a groove 272 for discharging the bubbles, but also with projections 274 and 276 which are sufficiently high so as to not disturb the movement of the vibrating plates 156 and 158 and which are joined by the groove 272.

According to this embodiment, the ink that enters between the back block 270 and the vibrating plates 156 and 158 forms a meniscus between the projections 274 and 276 with a constricted gap and the vibrating plates 156 and 158. Therefore, it is possible to reduce the fluid resistance at the gap by increasing the gap length between the upper and surface of the back block 270 and the vibrating plates 156 and 158. Accordingly, the ink can be supplied smoothly into the gap between the nozzle plate 174 and the vibrating plates 156 and 158 by increasing the amount of ink at the gap between the back block 270 and the vibrating plates 156 and 158. Further, it is noted that it is difficult to destroy a meniscus due to a disturbance by the projections 274 and 276, resulting in high reliability.

Figure 20:
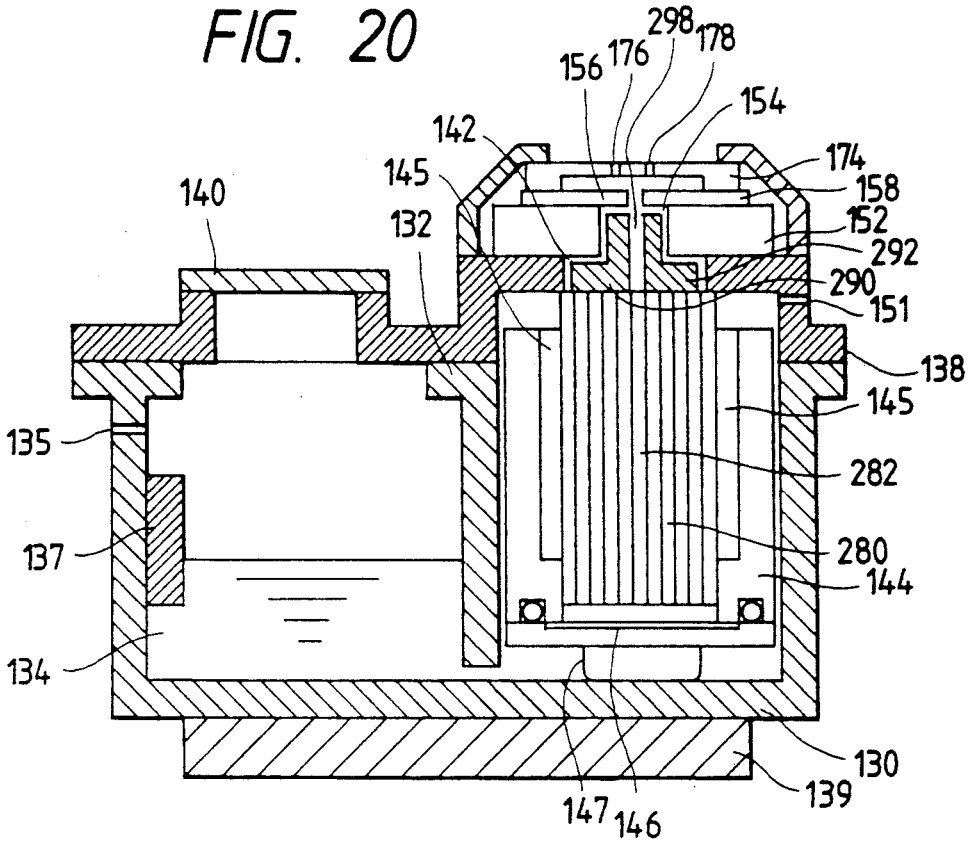
FIGS. 20 and 21 are a sectional view showing a fifth embodiment of the print head according to the present invention and a top view of the front of the vibrating plate block from which the vibrating plate has been removed.
Figure 21:
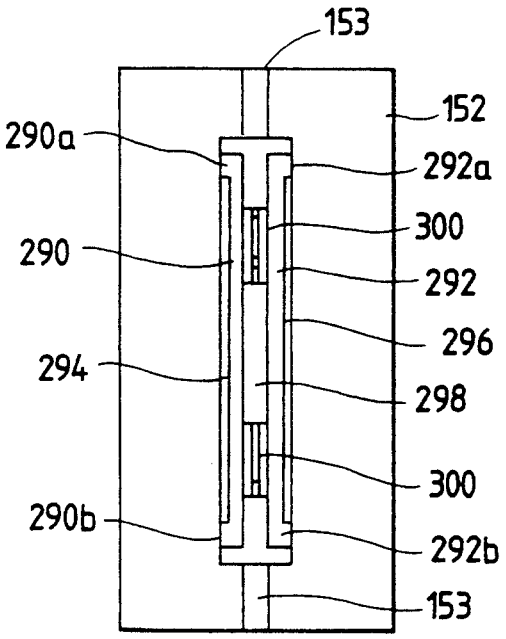
Figure 22:
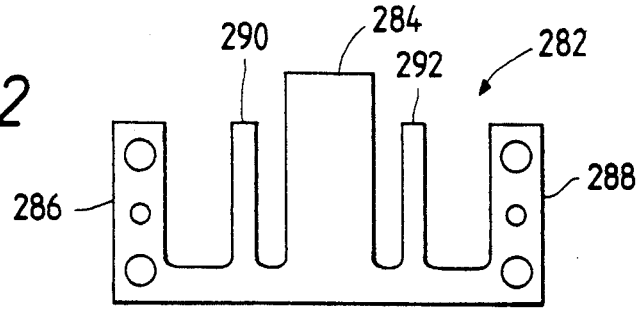
FIG. 22 is a front view showing an embodiment of a frame constituting an ink supplying structure used in the device shown in FIG. 20.
Figure 23A:
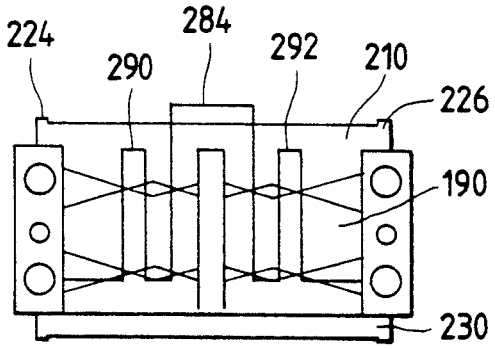
FIGS. 23*a*, 23*b*, and 23*c* are respectively a front view, a side view, and a top view showing the ink supply means of the device shown in FIG. 20.
Figure 23B:
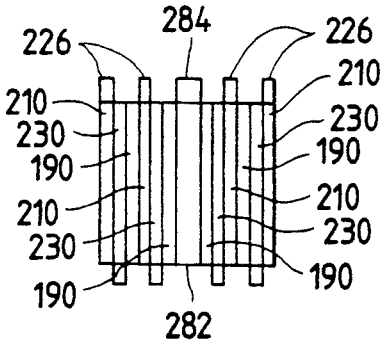
Figure 23C:
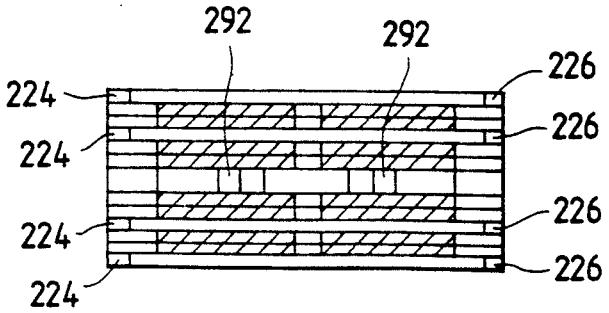

FIG. 20 shows a fifth embodiment of the inventive ink jet print head. An ink supply structure 280, composed of a frame element 282 located at its center when accommodated in a holder as shown in FIG. 21, is constructed by laminating the first to third members shown in FIGS. 12*a* to 12*c*, as described previously. The frame element 282 is constructed by a plate member thinner than a gap of the back block (described later) so that the upper end of a pillar 284 at the center rises higher than the upper end of both lateral sides 286 and 288, and also the plate member is made as high as both lateral sides 286 and 288 by being located it toward the center. The frame element 282 is also provided with auxiliary pillars 290 and 292 at a position not covering the windows 250, 252, 254, and 256 (FIG. 13*b*) which are formed when the first to third members 190, 210, and 230 are laminated.

The first to third members 190, 210, and 230 (FIGS. 12*a* to 12*c*) are assembled to form the ink supply structure 280, laminated in the order of the first, second, and third elements 190, 210, and 230 locating the frame element 282 at the center in the same manner as described previously.

Returning to FIG. 20, back block elements 290 and 292, which have an "L" shape in section, are provided with projections 290*a*, 290*b*, 292*a*, and 292*b* to form gaps 294 and 296 which allow the ink to be sucked by a capillary force on both confronting ends of the window 154 of the vibrating plate block 152. The back block elements 290 and 292 are of such a size as to not hold the ink by a capillary force when accommodated in the windows 142 and 154 of the upper casing 138 and the vibrating plate block 152, respectively, and are of such a size as to leave a gap 298 thicker than the thickness of the frame element 282.

The ink supply structure 280 is accommodated in the holder 144 covered by the upper casing 138, and the back block elements 290 and 292 are set back-to-back on the upper end of the ink supply structure 280 from the window 142 of the upper casing 138. Expansion springs 300 are inserted into the back surface of the back block elements 290 and 292, and then the vibrating plate block 152 is covered thereon. Accordingly, the respective back block elements 290 and 292 are urged by the upper casing 138 and the windows 142 and 154 of the vibrating plate block 152 to form not only the gaps 294 and 296 which are defined by the size of the projections 290*a*, 290*b*, 292*a*, and 292*b* between the side walls of the windows 142 and 154, but also the gap 298 which communicates with the discharge outlet on the back side of the back block elements 290 and 292.

According to this embodiment, proper control of the height of the projections 290*a*, 290*b*, 292*a* and 292*b* formed on the back block elements 290 and 292 allows the ink supply gaps to be formed with high accuracy. Further, it is possible to adjust the gaps with respect to the vibrating plates 156 and 158 by polishing the bottom surface or top surface of the back block elements 290 and 292.

Any bubbles produced in the ink present between the vibrating plates 156 and 158 and the back block elements 290 and 292, and those in the ink present between the vibrating plates 156 and 158 and the nozzle plate 174 are driven out to the ends of the vibrating plates 156 and 158 by movement of the vibrating plates 156 and 158, and discharged into the atmosphere from the throughholes 153 of the vibrating plate block 152 via the gap 298 formed by the back surface of the back block elements 290 and 292.

Figure 24:
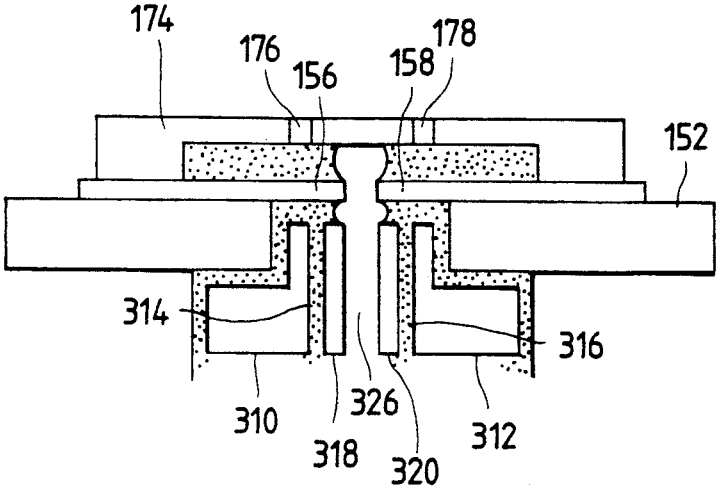
FIGS. 24 and 25, taken together, are a diagram showing a sixth embodiment Of a print head according to the present invention, specifically, the structure around the vibrating plate block and a top view of the front of the vibrating plate block from which the vibrating plate has been removed.
Figure 25:
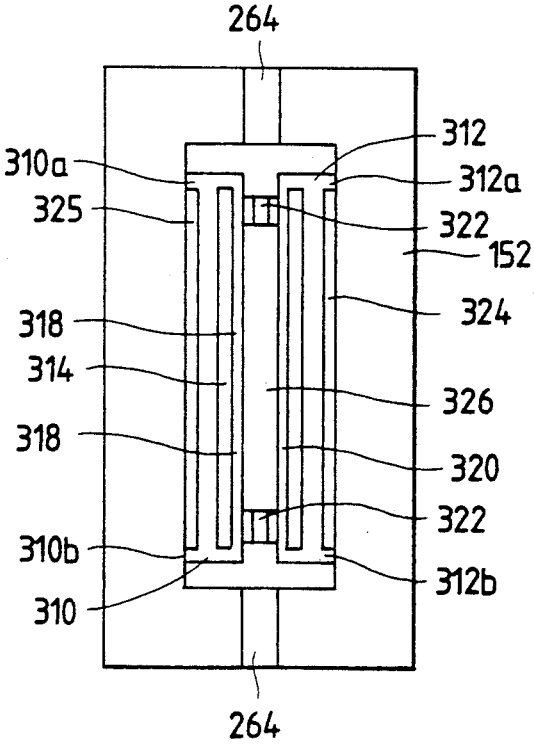

FIG. 24 shows a fifth embodiment of the back block. Back block elements 310 and 312 are provided with respective side walls 318 and 320 on their back surface side so that a gap wide enough to suck the ink by a capillary force can be formed.

In to this embodiment, expansion springs 322 are inserted into the back side of the perspective back block elements 318 and 320 so that gaps 324 and 325 defined by projections 310*a*, 310*b*, 312*a*, and 312*b* are formed between the upper casing 138 and the windows 142 and 154 of the vibrating plate block 152, and a groove 326 communicating with the atmosphere is formed at the center.

Therefore, the ink sucked by the ink supply structure 280 is raised to the vibrating plates 156 and 158 along the gaps formed by the back block elements 310 and 312, the upper casing 138, and the vibrating plate block 152, and by the gaps 314 and 316 formed between the back block elements 318 and 320, and thus forms meniscuses at the upper end of the side walls 318 and 320.

Accordingly, the ink is supplied to the vibrating plates 156 and 158 not only through the path formed between the upper casing 138 and the vibrating plate block 152, but also through the gaps 314 and 316 formed between the back block elements 318 and 320, thereby allowing sufficient ink for high speed printing to be supplied.

If bubbles are mixed into the ink that has entered into the gap between the vibrating plates 156 and 158 and the back block elements 318 and 320, these bubbles are pushed out to the end of the vibrating plates by movement of the vibrating plates 156 and 158, and discharged into the atmosphere from the grooves 264 of the vibrating plate block 152 through the gap 326 formed on the back surface of the back block elements 310 and 312.

Although the case where hot melt type ink is used was taken as an example in the foregoing pages, it goes without saying that similar effects will be obtained when using ink which is liquid at ambient temperature.

What is claimed is:

1. An on-demand ink jet print head comprising:

a horizontally arranged nozzle plate having formed therein a plurality of nozzle openings facing upward;

a plurality of vibrating members disposed below said horizontally arranged nozzle plate, each of said vibrating members having one end secured to a base and another end confronting said nozzle openings, said vibrating members being arranged in an array having at least one row and one column in a horizontal plane forming a gap wide enough to hold ink in cooperation with said nozzle plate by a capillary force;

a frame member serving also as an ink tank; and ink supply means for supplying said ink by a capillary force from said ink tank to said vibrating members.

2. The on-demand ink jet print head according to claim 1, wherein said ink supply means comprises a plurality of vertically arranged plate members, two adjacent members of which form a gap wide enough to suck said ink by a capillary force.

3. The on-demand ink jet print head according to claim 1, wherein said ink supply means has a back plate arranged on an upper end thereof to form a groove in a direction of arraying said nozzle openings so that bubbles produced within said ink around said vibrating members can be discharged outside of said print head through said groove.

4. The on-demand ink jet print head according to claim 1, further comprising cleaning means for rubbing the surface of said nozzle plate.

5. The on-demand ink jet print head according to claim 1, wherein said frame member is provided with heating means for melting a hot melt type ink.

6. The on-demand ink jet print head according to claim 1, further comprising auxiliary heating means for reducing the viscosity of the ink arranged around said back plate.

7. An on-demand ink jet print head comprising:

a horizontally arranged nozzle plate having formed therein a plurality of nozzle openings facing upward;

a plurality of vibrating members disposed below said horizontally arranged nozzle plate, each of said vibrating members having one end secured to a base and another end confronting said nozzle openings, said vibrating members being arranged in an array having at least one row and one column in a horizontal plane forming a gap wide enough to hold ink in cooperation with said nozzle plate by a capillary force;

a back block arranged below said vibrating members with a gap wide enough to produce a capillary force on said ink; and ink supply means for supplying said ink by capillary force from said ink tank to said vibrating members.

8. The on-demand type ink jet print head according to claim 7, wherein said ink supply means comprises at least three thin plates, said thin plates having windows communicating with each other straightly in a laminating direction of said thin plates, a gap of a non-uniform width forming an ink supply path in a direction vertical to said laminating direction, said thin plates being arranged such that said ink supply path runs vertical.

9. The on-demand type ink jet print head according to claim 7, wherein said back block comprises a back plate arranged on an upper end thereof to form a groove in a direction of array of said nozzle openings so that bubbles produced within said ink around said vibrating members can be discharged to the outside through said groove.

10. The on-demand type ink jet print head according to claim 7, wherein said back block comprises two symmetric elements and forms a gap for discharging said bubbles on confronting sides of said two elements.

11. The on-demand type ink jet print head according to claim 10, wherein said back block is provided with a second ink supply path.

12. The on-demand type ink jet print head according to claim 9, further comprising an expansion spring interposed between confronting surfaces of said back block.

13. The on-demand type ink jet print head according to claim 9, wherein said vibrating members have a cantilevered configuration having a free end and a fixed end, ink being supplied from a fixed end side of said vibrating members.

14. The on-demand type ink jet print head according to claim 13, wherein a gap is provided between said back block and said nozzle plate in a vicinity of said free ends of said vibrating members.

15. The on-demand type ink jet print head according to claim 1, wherein said ink supply means comprises an ink flowing path means that is in communication with the atmosphere.

* * * * *